US009116495B2

(12) United States Patent
Takagi

(10) Patent No.: US 9,116,495 B2
(45) Date of Patent: Aug. 25, 2015

(54) IMAGE FORMING APPARATUS AND METHOD FOR CONTROLLING DRIVE CONDITION OF BELT

(71) Applicant: CANON KABUSHIKI KAISHA, Tokyo (JP)

(72) Inventor: Kiyoshi Takagi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/890,468

(22) Filed: May 9, 2013

(65) Prior Publication Data

US 2013/0308962 A1 Nov. 21, 2013

(30) Foreign Application Priority Data

May 15, 2012 (JP) ..... 2012-111700

(51) Int. Cl.
*G03G 15/00* (2006.01)
*G03G 15/16* (2006.01)

(52) U.S. Cl.
CPC ..... *G03G 15/70* (2013.01); *G03G 15/1615* (2013.01); *G03G 15/5054* (2013.01); *G03G 2215/00156* (2013.01)

(58) Field of Classification Search
USPC ..... 399/162, 165, 301
See application file for complete search history.

(56) References Cited

U.S. PATENT DOCUMENTS

| | | | | |
|---|---|---|---|---|
| 7,684,740 | B2 * | 3/2010 | Matsuda et al. | 399/301 |
| 2002/0034400 | A1 * | 3/2002 | Asuwa et al. | 399/165 |
| 2007/0144871 | A1 * | 6/2007 | Tao et al. | 198/810.03 |

FOREIGN PATENT DOCUMENTS

| | | |
|---|---|---|
| JP | 2005-107118 A | 4/2005 |
| JP | 2008-111928 A | 5/2008 |

* cited by examiner

*Primary Examiner* — Matthew G Marini
(74) *Attorney, Agent, or Firm* — Fitzpatrick, Cella, Harper & Scinto

(57) ABSTRACT

A control apparatus executes feedback control on an endless belt driven in a condition having a periodic disturbance to compensate an influence of the periodic disturbance. A disturbance other than the periodic disturbance is added to the belt during feedback control, and the control apparatus obtains phase angles of the periodic disturbance on timing when the other disturbance is added. The control apparatus obtains interpolation coefficients that respectively interpolate values of feedforward inputs in the case when the other disturbance is added at the time when phase angles of the periodic disturbance stored in a memory are a plurality of typical angles, and adds values obtained by adding values obtained by multiplying the interpolation coefficients respectively by the feedforward inputs to a control value of feedback control as a correction value.

2 Claims, 12 Drawing Sheets

IMAGE FORMING APPARATUS AND METHOD FOR CONTROLLING DRIVE CONDITION OF BELT

BACKGROUND OF THE INVENTION

1. Field of the Invention

The present invention relates to an image forming apparatus, and a method for controlling a driving condition of a belt driven in a condition having a periodic disturbance.

2. Description of the Related Art

An image forming apparatus such as a copier and a printer is known to have a structure using an intermediate transfer belt configured to superimpose toner images formed on photoconductive drums of respective colors and to transfer and form the superimposed image to a recording member such as a sheet. Because the intermediate transfer belt is wrapped around a drive roller, a tension roller and others, the belt is apt to meander or to lean to one-side in a belt widthwise direction during its travel due to such disturbances caused by imprecision of the rollers and of parallelism of the belt and a distribution of tension of the belt itself, and a disturbance caused when the recording member rushes into the belt. The meandering of the belt and the leaning of the belt to one-side in the belt widthwise direction will be referred simply as a "shift of widthwise position" or a "shift" hereinafter.

Because this shift causes misregistration of the respective color images in composing the respective color images, the image forming apparatus is arranged to correct the shift of the belt by executing steering control. The steering control is an operation for correcting the shift of the belt by detecting a widthwise position when the belt is shifted or shift speed of the intermediate transfer belt by sensors and by carrying out feedback control of slanting a specific roller (referred to as a "steering roller" hereinafter) based on detected values.

It is also known that speed of shift of the belt caused by the slant of the roller of the steering method is proportional to moving speed of the belt in a rotational direction (referred to as "belt moving speed" hereinafter). This indicates that behaviors of the belt in the widthwise and rotational directions are linked with each other, so that it is necessary to take this linkage into account in order to control the shift (widthwise position) of the belt in high precision.

Taking such linkage into account, a configuration that translates feedback gains of the belt shift control into a variable gain control system regarding the belt moving speed is being proposed. According to the configuration, an adjustment of a feedback control system of the belt shift control is made first with a normal belt moving speed called a belt reference speed. However, if the belt moving speed varies after that and differs from the belt reference speed, the shift feedback control system is destabilized because an amount of shift per unit time varies. If the belt moving speed increases as a result, a loop gain of the shift feedback control system becomes too high and a response of the shift starts to oscillate. Then, Japanese Patent Application Laid-open No. 2008-111928 stabilizes a closed loop by multiplying the shift feedback control system by a value obtained by dividing the belt reference speed by the belt moving speed. This method will be referred to as a "variable gain method" hereinafter.

Meanwhile, it is effective to feedforward control the steering roller on the timing when a recording member rushes into the belt to suppress a shift caused by a sudden disturbance (other disturbance) such as the inrush of the recording member. To that end, Japanese Patent Application Laid-open No. 2005-107118 proposes a configuration that estimates the timing when the recording member rushes into the intermediate transfer belt by using sensors for detecting the recording member and implements the feedforward control on the belt moving speed. This configuration prevents the belt moving speed from dropping when the recording member rushes into the belt by executing such feedforward control.

The variable gain method described above in Japanese Patent Application Laid-open No. 2008-111928 is effective under a condition in which the belt moving speed fluctuates in ramp due to a periodic disturbance caused by decentration or the like of the suspension roller. However, if the belt moving speed drops oscillatively and suddenly due to the other disturbance such as the inrush of the recording member, there is a possibility that a gain of the feedback control system becomes high, considerably varying a steering amount.

Still further, the method for controlling the belt in terms of its traveling direction described in Japanese Patent Application Laid-open No. 2005-107118 will do just by generating a sole feedforward input corresponding only to a condition if the condition is that the same type of recording member rushes into the belt at constant speed. However, in the control of the shift of the belt, although a large deviation of the widthwise position is generated if a steering amount is large when the disturbance occurs due to the inrush of the recording member, almost no deviation of the widthwise position is generated when the steering amount is small when the disturbance occurs. Thus, this shift feedforward control of this method has a problem that a large number of feedforward inputs have to be generated and stored in advance even under the condition that the same type of recording members rush into the belt at a constant speed.

SUMMARY OF THE INVENTION

According to a first aspect of the invention, there is provided an image forming apparatus comprising an image forming portion configured to form an image, a belt unit including a drive roller, an endless belt wrapped around the drive roller and driven in a condition of having a periodic disturbance, and a steering mechanism configured to move the belt in a widthwise direction, the belt unit being capable of forming a nip portion into which a recording member rushes through the belt and which cause an other disturbance other than the periodic disturbance in the belt by the inrush of the recording member, a memory storing values of a plurality of feedforward inputs corresponding to different typical angles set in advance among phase angles of the periodic disturbance and corrects control values of the steering mechanism, each value of the feedforward input compensating the other disturbance caused when the recording member rushes into the nip portion on the timing when the phase angle of the periodic disturbance is the corresponding typical angle, and a control portion configured to feedback control a widthwise position of the belt such that an influence of the periodic disturbance is compensated through the steering mechanism, and configured such that when the control portion detects the timing when the recording member is to rush into the nip portion during the feedback control, the control portion obtains feedforward phase angle which is phase angle of the periodic disturbance on the timing when the other disturbance is caused in the belt, obtains interpolation coefficients for the values of the respective feedforward inputs stored in the memory based on the feedforward phase angle, and adds a total of each value obtained respectively by multiplying the interpolation coefficients by the corresponding feedforward inputs to the control value of the feedback control of the steering mechanism as a correction value.

According to a second aspect of the invention, there is provided a method for controlling a driving condition of an endless belt driven in a condition having a periodic disturbance and an other disturbance other than the periodic disturbance, comprising steps of feedback controlling a widthwise position of the belt by a steering mechanism that is configured to move the belt in the widthwise direction such that an influence of the periodic disturbance is compensated, estimating or detecting a phase angle of the periodic disturbance on the timing when the other disturbance is added to the belt in response to detecting that the other disturbance is to be added during the feedback control, obtaining interpolation coefficients that respectively interpolate values of feedforward inputs when the other disturbance is added in case of a plurality of typical angles set in advance among phase angles of the periodic disturbance stored in the memory based on the estimated or detected phase angles of the periodic disturbance and adding values obtained by multiplying these interpolation coefficients by the values of the corresponding feedforward inputs, and controlling the steering mechanism by adding the values obtained by multiplying the interpolation coefficients by the values of the corresponding feedforward inputs to control values of the feedback control as a correction value.

Further features of the present invention will become apparent from the following description of exemplary embodiments with reference to the attached drawings.

DESCRIPTION OF THE EMBODIMENT

<First Embodiment>

A first embodiment of the invention will be described with reference to FIGS. 1 through 12. Firstly, a configuration of an image forming apparatus to which a control apparatus of the embodiment is applied will be schematically explained with reference to FIG. 1.

(Image Forming Apparatus)

Figure 1:
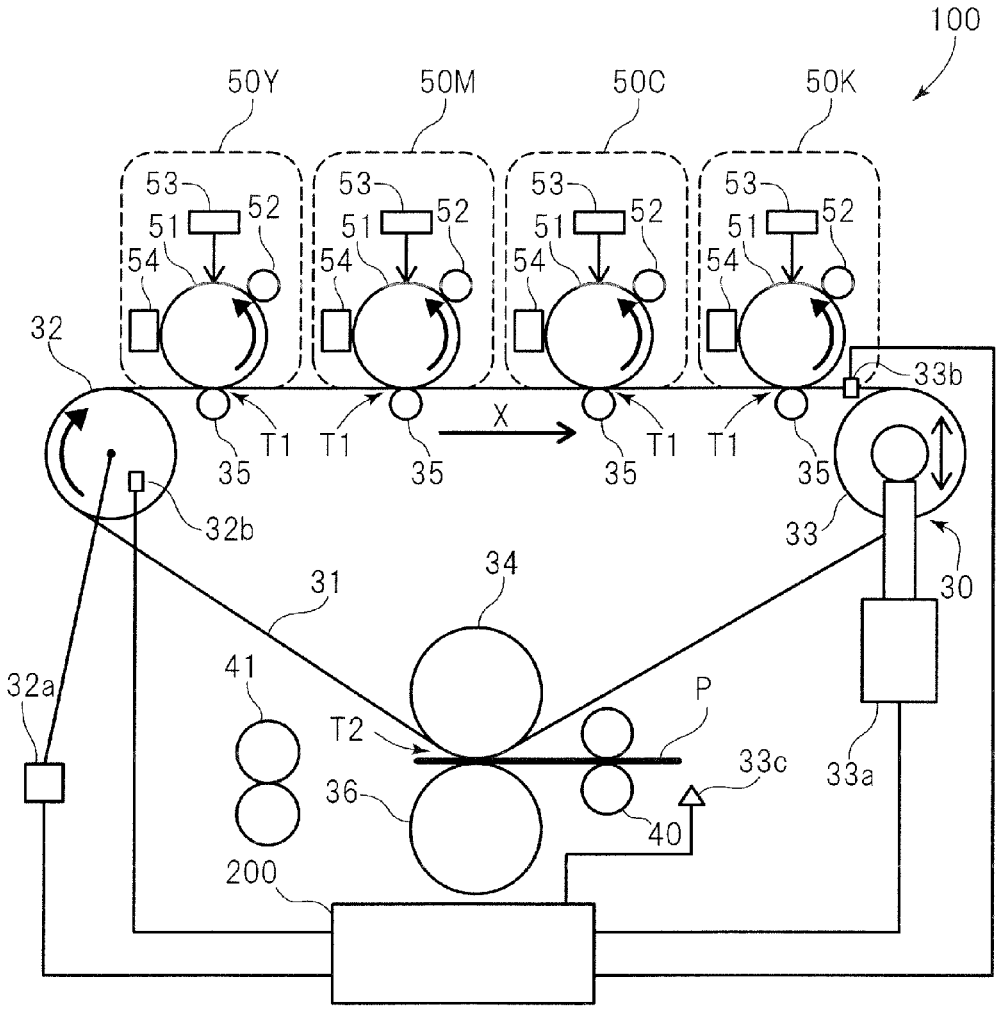
FIG. 1 is a section view schematically showing a structure of an image forming apparatus according to an embodiment of the invention.

The image forming apparatus 100 shown in FIG. 1 is a so-called tandem-type image forming apparatus in which a plurality of image forming portions 50Y, 50M, 50C, and 50K forming yellow, magenta, cyan, and black toner images is arrayed in a rotational direction (traveling direction) of an intermediate transfer belt 31. Such image forming apparatus 100 includes a belt unit 30 configured to superimpose the toner images formed in the respective image forming portions on the intermediate transfer belt 3 and to transfer the superimposed toner image to a recording member as described later. It is noted that the same reference numerals denote the same or corresponding parts throughout the drawings.

A structure of the image forming portion will be explained first. Because structures of the image forming portions 50Y, 50M, 50C and 50K respectively forming the yellow, magenta, cyan and black toner images are basically all the same, the structure and image forming operations of the yellow image forming portion 50Y will be briefly explained, and an explanation of the other image forming portions will be omitted here. The image forming portion 50Y includes a photoconductive drum 51 as an image carrier. Disposed around the photoconductive drum 51 are a charging roller 52, i.e., a charging member, an exposure unit 53, a developing unit 54, and a drum cleaning blade not shown.

On starting to form an image, the charging roller 52 in contact with the photoconductive drum 51 charges a surface of the photoconductive drum 51 homogeneously with a predetermined voltage at first. Then, the exposure unit 53 receives image information from a host apparatus not shown and exposes the surface of the photoconductive drum 51 with laser light in which the information is modulated by time-series digital image signals to form an electrostatic latent image. Here, the host apparatus is a document reader such as a scanner, an external terminal such as a personal computer, or the like for example. The developing unit 54 then applies a developing bias voltage to attach yellow toner to the electrostatic latent image and to form a toner image.

The belt unit 30 includes the intermediate transfer belt (transfer medium) 31 which is an endless belt as a moving member, a drive roller 32 capable of supporting and rotating the belt 31, a driven roller 33, primary transfer rollers 35, a secondary transfer roller 34, and a belt cleaning blade not shown. The drive roller 32 around which the intermediate transfer belt 31 is wrapped is rotationally driven by a motor 32*a* and rotationally drives the intermediate transfer belt 31 in a direction indicated by an arrow X. The driven roller 33 functions also as a steering roller that moves the intermediate transfer belt 31 in a width direction, i.e., a direction in parallel with a surface of the intermediate transfer belt 31 and intersecting the rotational direction of the intermediate transfer belt 31, as described later. The driven roller 33 is also pressed by a tension spring not shown to apply a certain tension to the intermediate transfer belt 31 to prevent deflection of the belt 31.

In forming an image, the belt unit 30 transfers the yellow toner image formed on the surface of the photoconductive drum 51 to the intermediate transfer belt 31 at a primary transfer portion T1 by applying a primary transfer bias voltage to the intermediate transfer belt 31 by the primary transfer roller 35. The belt unit 30 conveys the toner image transferred to the intermediate transfer belt 31 to the magenta image forming portion 50M to superimpose the yellow toner image with a magenta toner image. The belt unit 30 superimposes cyan and black toner images in the same manner to form a full-color toner image on the intermediate transfer belt 31.

The belt unit 30 sends the full-color toner image formed on the intermediate transfer belt 31 to a secondary transfer portion T2 to transfer onto a recording member P, which is conveyed to (rushed into) the secondary transfer portion T2 in synchronism with the toner image, by applying a secondary transfer bias voltage by the secondary transfer roller 34. Here, the recording member P is conveyed to the secondary transfer portion T2 from a sheet feeding cassette not shown by registration rollers 40 and others. That is, the belt unit 30 composes the secondary transfer portion T2 by the secondary transfer roller 34, a counterface roller 36, and the intermediate transfer belt 31 as a nip portion into which the recording member rushes between the intermediate transfer belt 31 and the counterface roller 36. Then, the recording member P on which the full-color image has been transferred is sent to a fixing unit 41 to implement an image fixing process such as heating and pressing, and is discharged to a tray not shown. The belt cleaning blade not shown in contact with the intermediate transfer belt 31 removes toner remaining on the intermediate transfer belt 31 after the secondary transfer process.

The image forming apparatus 100 of the present embodiment also includes a steering mechanism 33*a* having actuators 33$a_1$ and 33$a_2$ that move support portions at ends of the driven roller 33 in a direction intersecting an axis of rotation of the roller 33, e.g., in a vertical direction in FIG. 1 as indicated by an arrow in the driven roller 33 in FIG. 1. The steering mechanism 33*a* is controlled by a control apparatus 200. That is, the control apparatus 200 controls the steering mechanism 33*a* based on signals of a shift sensor (widthwise position sensor) 33*b* that detects a widthwise end position of the intermediate transfer belt 31, and a recording member detecting sensor 33*c* that detects a position of the recording member P before the recording member P rushes into the secondary transfer portion T2. The control apparatus 200 also controls the motor 32*a* based on a signal of an encoder 32*b* which is a rotation detecting sensor that detects rotation of the drive roller 32 to control rotational speed of the drive roller 32 as well as rotational speed (belt moving speed) of the intermediate transfer belt 31.

It is noted that although FIG. 1 shows only the actuator 33$a_1$ of the steering mechanism 33*a* on the front side of the driven roller 33 in FIG. 1, the steering mechanism 33*a* has the similar actuator 33$a_2$ (see FIG. 2) on the back side of the driven roller in FIG. 1. However, the steering mechanism may be also constructed such that one side of the driven roller is fixed by a hinge or the like and an actuator is provided on the other side. At any rate, a difference of levels in the vertical direction in FIG. 1 is produced between both ends of the driven roller 33 by using the steering mechanism 33*a*. This configuration makes the driven roller 33 be inclined along a direction vertical to the sheet of FIG. 1 (front-back direction in FIG. 1) and permits to control a shift (widthwise position) of the intermediate transfer belt 31. That is, this configuration makes it possible to control the widthwise position of the intermediate transfer belt 31 (belt shift control). It is noted that although FIG. 1 shows the steering mechanism of the linear motion-type actuator, it is also possible to use a rotational actuator by using such a conversion mechanism as a cam mechanism or to use a transmission mechanism such as a link mechanism.

(Control Apparatus)

Figure 2:
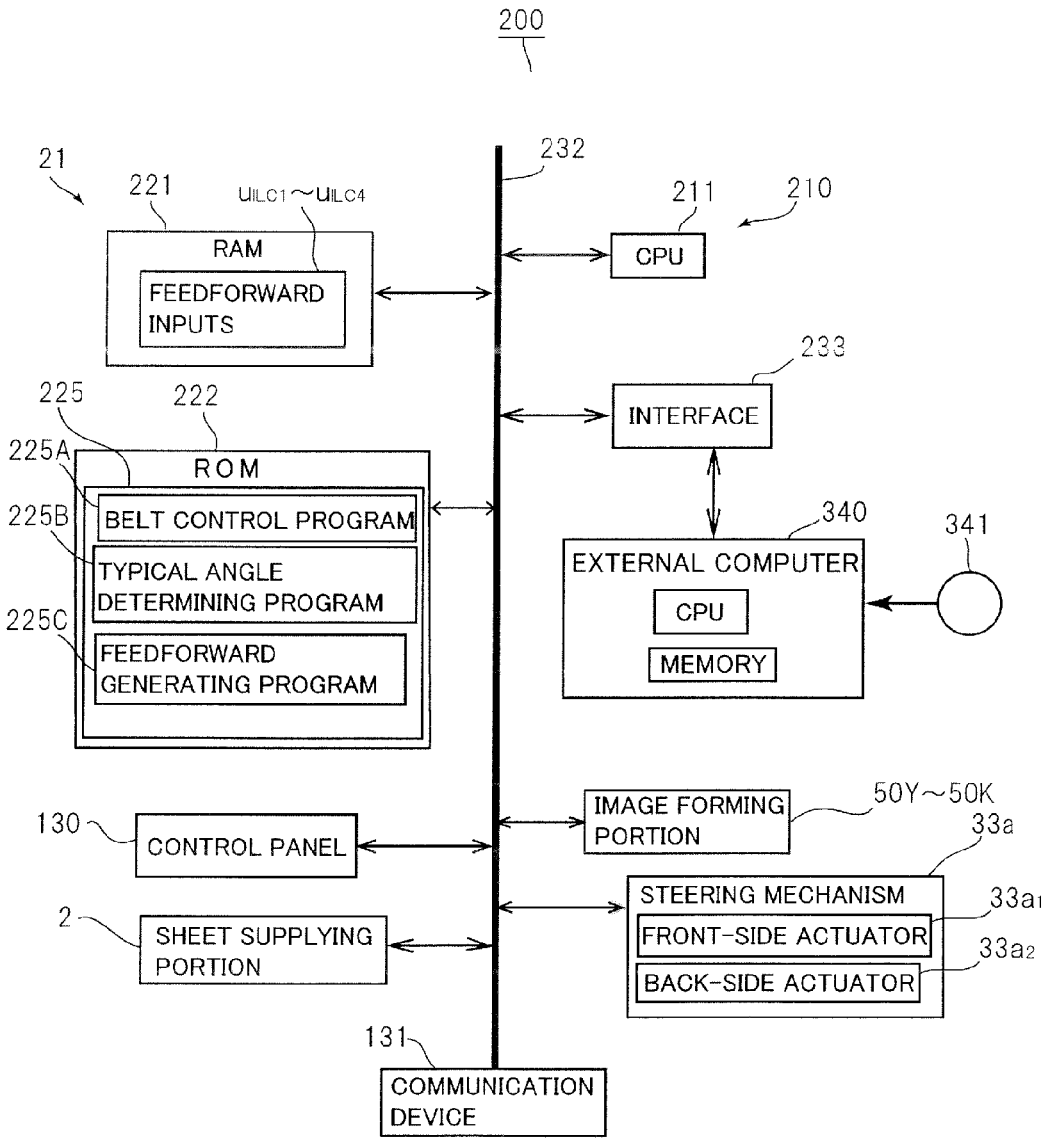
FIG. 2 is a block diagram showing a configuration of a control apparatus of the embodiment of the invention.

A configuration of the control apparatus 200 described above will now be explained with reference to FIGS. 2 and 3. The control apparatus 200 controls the belt moving speed and the shift of the belt as described above. Specifically, as shown in FIG. 2, the control apparatus 200 includes an arithmetic unit (processor) 210 mainly by a CPU 211 which is connected with memories 21 such as a ROM 222 and a RAM 221 through a bus 232. The ROM 222 stores a driver 225 including such programs as a belt control program 225A configured to execute belt controls such as the steering control described above, a typical angle determining program 225B configured to determine typical angles described later, and a feedforward generating program 225C configured to generate feedforward input values described later. Besides the driver 225, the ROM 222 also stores various programs necessary for basically controlling the image forming apparatus 100. Besides a working space assured for the CPU 211, the RAM 221 stores values of the feedforward inputs $u_{ILC1}$, $u_{ILC2}$, $u_{ILC3}$, and $u_{ILC4}$ described later. It is noted that the RAM 221 is provided with a backup power source so that no data is lost when power is shut down. The feedforward inputs $u_{ILC1}$, $u_{ILC2}$, $u_{ILC3}$, and $u_{ILC4}$ may be stored also in the ROM 222, and the driver 225 may be stored in the RAM 221.

The CPU 211 is connected with a control panel 130 through the bus 232 and with an external computer 340 through the bus 232 and an input interface 233. Therefore, a user can input various data such as a print job, setting of size of a sheet in a cassette to the image forming apparatus 100 from the control panel 130 and the external computer 340.

The CPU 211 is also connected with a sheet supplying portion 60 that supplies a sheet to the secondary transfer portion T2, the image forming portions 50Y, 50M, 50C and 50K described above, and the front and back actuators 30$a_1$ and 30$a_2$ of the steering mechanism 30*a* through the bus 232. The CPU 211 is also connected with the various sensors such as the shift sensor 33*b*, the recording member detecting sensor 33*c*, and the encoder 32*b* such that their detection signals are input through the bus 232.

Figure 3:
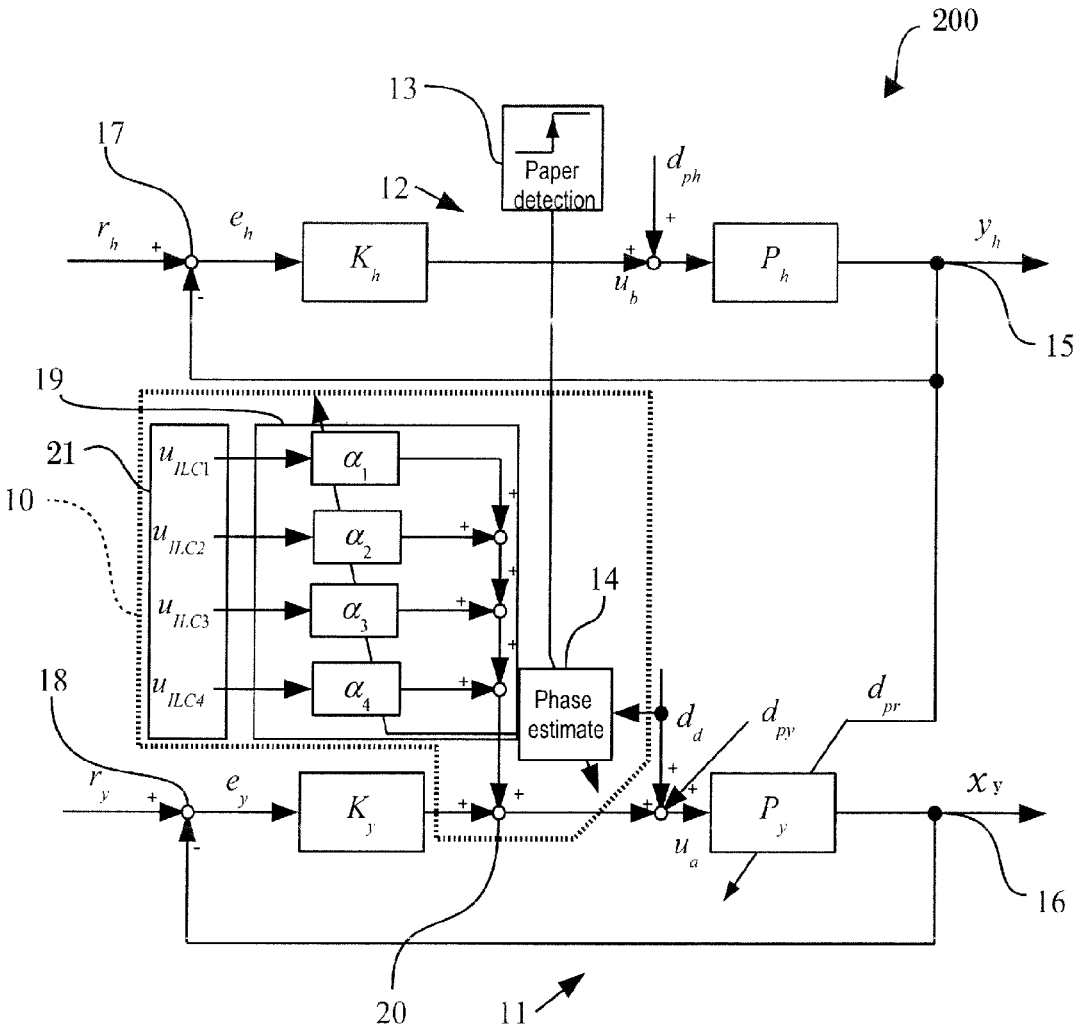
FIG. 3 is a schematic block diagram showing the control apparatus of the embodiment.

FIG. 3 is a control block diagram representing the functions of the CPU 211 based on the belt control program 225A as a control model (control circuit). As shown in FIG. 3, in order to control the behavior of the intermediate transfer belt 31, the CPU 211 of the control apparatus 200 functions as a speed control circuit 12 configured to control belt moving speed and a shift control circuit 11 configured to control the belt widthwise position. These speed control and shift control circuits 12 and 11 are configured as feedback control circuits, respectively. In the present embodiment, the CPU 211 also functions as a feedforward control circuit 10 configured to perform feedforward control on a shift of the widthwise position of the belt exerted by another disturbance caused by the inrush of the recording member P to the secondary transfer portion T2.

Here, $P_h$ of the speed control circuit 12 is a transfer function from a command of voltage to the motor 32*a* to a belt moving speed, and $P_y$ of the shift control circuit 11 is a transfer function from a steering amount to a widthwise position displacement.

The speed control circuit 12 is configured to detect the belt moving speed $y_h$ by a detecting portion 15. The signal from the encoder 32*b*, i.e., the rotation detecting sensor of the drive roller 32, is sent to the detecting portion 15. It is noted that while it is possible to detect the belt moving speed by detecting the speed of the belt itself, it is also possible to detect the speed by detecting an angular speed of the drive roller 32 and by multiply it by an invariable number as with the present embodiment. The belt moving speed $y_h$ detected by the detecting portion 15, i.e., an output of the detecting portion 15, is subtracted from a target speed $r_h$ in a subtracting portion 17, and its deviation $e_h$ is input to a feedback controller $K_h$.

The shift control circuit 11 is configured to detect the belt widthwise position displacement $x_y$ by a detecting portion 16. The signal from the shift sensor 33*b* that detects the widthwise end position of the belt 31 is sent to the detecting portion 16. The belt widthwise position displacement $x_y$ detected by the detecting portion 16, i.e., an output of the detecting portion 16 or a control value of the shift control circuit 11, is subtracted from a target position $r_y$ in a subtracting portion 18, and its deviation $e_y$ is input to a feedback controller $K_y$. The target position of the widthwise position (target widthwise position displacement) is zeroed in the present embodiment. That is, the shift control circuit 11 of the embodiment controls a driving condition, e.g., the belt widthwise position displacement, of the intermediate transfer belt 31, i.e., amoving member, driven in a condition having a periodic disturbance caused by decentration and others of the drive roller 32 such that the shift control circuit 11 compensates an influence of the periodic disturbance.

Since the signal from the recording member detecting sensor 33*c* is sent to the detecting portion 13, it is possible to detect the timing when the recording member P rushes into the secondary transfer portion T2, i.e., an inrush of the recording member, from this signal. That is, the detecting portion 13 functions another disturbance detecting portion that detects the timing when the other disturbance is additionally caused in the intermediate transfer belt 31, i.e., the moving member, by the inrush of the recording member other than the periodic disturbance caused by the decentration of the roller and others. The feedforward inputs are given to the steering mechanism 33*a* on this timing.

A disturbance exerted on the belt moving speed due to the inrush of the recording member will be denoted by $d_{ph}$, a disturbance exerted on the belt widthwise position displacement due to the inrush of the recording member by $d_{py}$, and a disturbance exerted on the belt widthwise position displacement appearing due to the fluctuation of the belt moving speed by $d_{pr}$, respectively, hereinafter. The periodic disturbance exerted on the belt widthwise position displacement due to the axial decentration of the steering roller itself or of the other roller such as the drive roller will be also denoted by $d_d$.

A configuration of the feedforward control circuit 10 that executes the feedforward control on the shift caused by the other disturbance will now be explained. The steering roller, i.e., the driven roller 33, always varies a steering amount in order to compensate meandering of the belt, i.e., the influence, caused by the periodic disturbance $d_d$. That is, the feedback control is made by the shift control circuit 11. Due to that, even if the timing when the other disturbance caused by the inrush of the recording member is constant every time, responses of the shift (widthwise position displacement) varies depending on the steering amount on the timing of the inrush of the recording member.

Then, a phase angle $\phi_t$ of the periodic disturbance $d_d$ that is a cause that determines the steering amount is detected on the timing of the inrush of the recording member and the feedforward inputs for compensating the (other) disturbance caused by the inrush of the recording member other than the periodic disturbance $d_d$ are generated in the present embodiment. However, a large amount of memory is required to prepare the feedforward inputs for all phase angles. Then, the feedforward control circuit 10 stores the feedforward inputs $u_{ILC1}$, $u_{ILC2}$, $u_{ILC3}$, and $u_{ILC4}$ related to the disturbance caused by the inrush of the recording member corresponding respectively to at least four each different types of phase angles of the periodic disturbance set in advance in the memory 21, i.e., a memory portion, in the present embodiment. Then, the feedforward control circuit 10 interpolates these feedforward inputs respectively based on the phase angle $\phi_t$ of the periodic disturbance $d_d$ and adds (superposes) the interpolated feedforward inputs to the shift control circuit 11 described above.

That is, to that end, the feedforward control circuit 10 includes the detecting portion 13, a phase angle estimating portion 14, an interpolation calculating portion 19, and an adding portion 20, in addition to the memory 21. The phase angle estimating portion 14 estimates the feedforward phase angle $\phi_t$, i.e., the phase angle $\phi_t$ of the periodic disturbance $d_d$, on the timing of the (other) disturbance additionally caused in the intermediate transfer belt 31 due to the inrush of the recording member as detected by the detecting portion 13 as described above. That is, the recording member P rushes into the secondary transfer portion T2 after an elapse of a predetermined time since when the recording member detecting sensor 33*c* detects a front edge of the recording member P. The periodic disturbance $d_d$ is input also to the phase angle estimating portion 14. Therefore, the phase angle estimating portion 14 can estimate the phase angle $\phi_t$ of the periodic disturbance $d_d$ on the timing of the inrush of the recording member.

It is noted here that there exists a correlation between the phase angle $\phi_t$ of the periodic disturbance $d_d$ and an amount of decentration of the roller. Accordingly, it is possible to estimate the phase angle $\phi_t$, e.g., a phase angle when the decentration of the roller is maximized at the time of the inrush of the recording member, of the periodic disturbance $d_d$ of the drive roller 32 by detecting the rotational angle of the belt 31 by the encoder 32*b*. It is noted that the phase angle estimating portion 14 may be arranged to actually detect the phase angle of the periodic disturbance on the timing of the inrush of the recording member. Although the phase angle estimating portion 14 will be described as what estimates the phase angle of the periodic disturbance in the following explanation, the same applies to the case when the phase angle estimating portion 14 detects the phase angle.

The interpolation calculating portion 19 determines the interpolation coefficients that interpolate the feedforward inputs respectively based on the phase angle $\phi_t$ of the periodic disturbance $d_d$ estimated by the phase angle estimating portion 14 as described later. Then, the interpolation calculating portion 19 adds values obtained by multiplying the respective feedforward inputs by the determined interpolation coefficients. The adding portion 20 adds an output calculated by the interpolation calculating portion 19 to the shift control circuit 11. These processes will be explained specifically below.

At first, four types of the phase angles (typical angles) of the periodic disturbance are stored in the memory 21 in advance in the present embodiment. The interpolation calculating portion 19 determines the respective interpolation coefficients such that the interpolation coefficients for the feedforward inputs of the phase angles close to the phase angles of the periodic disturbance estimated by the phase angle estimating portion 14, among the respective phase angles of periodic disturbance set in the memory in advance, becomes greater. That is, only four types of feedforward inputs $u_{ILC1}$, $u_{ILC2}$, $u_{ILC3}$, and $u_{ILC4}$ corresponding to the typical four phase angles $\phi_1$, $\phi_2$, $\phi_3$, and $\phi_4$ are stored in the memory 21 in advance. Then, the interpolation calculating portion 19 obtains the interpolation coefficient $\alpha_i$ (i=1 to 4) such that the closer to the typical angle $\phi_i$ (i=1 to 4) the phase angle $\phi_t$ of the periodic disturbance $d_d$ estimated by the phase angle estimating portion 14 is, the greater the feedforward input $u_{ILCi}$ (i=1 to 4) corresponding to that becomes, from the following Equation 1:

$$\alpha_i = \begin{cases} \cos(\varphi_t - \varphi_i - \varphi_f), & \frac{(4n-5)\pi}{2} \le \varphi_t - \varphi_i \le \frac{(4n-3)\pi}{2} \\ 0, & \frac{(4n-3)\pi}{2} < \varphi_t - \varphi_i < \frac{(4n-1)\pi}{2} \end{cases} \quad (1)$$

Where $\phi_f$ in Equation 1 is a design parameter that regulates a bias of the phase angle, and n is a natural number. Equation 1 as expressed above means that a difference $(\phi_t-\phi_i)$ from the phase angle $\phi_t$ of the periodic disturbance $d_d$ of the four typical angles $\phi_i$ falls within ±90 degrees. That is, Equation 1 is arranged such that a value of $\cos(\phi_t-\phi_i)=\alpha_i$ does not take a negative value even when $\phi_f$ is zero. If such case when $\alpha_i$ takes a negative value is included, it is unable to compensate favorably when $\alpha_i$ is multiplied by the feedforward inputs $u_{ILCi}$ and the multiplied values are all added, because $\phi_1$ is shifted from $\phi_4$ by 180 degrees as described later. In other words, each respective interpolation coefficient is set such that the value of the interpolation coefficient multiplied by the value of the feedforward input whose typical angle is relatively close to the feedforward phase angle and which are stored in the memory 21 are equal to or greater than the value of the interpolation coefficient multiplied by the value of the feedforward input whose typical angle is relatively far from the feedforward phase angle and which are stored in the memory 21. More specifically, the four interpolation coefficients $\alpha_i$ (i=1 to 4) to be multiplied by the four types of feedforward inputs are set such that a value of one interpolation coefficient is greater than a value of an other interpolation coefficient, wherein one interpolation coefficient is determined such that the typical angle of the feedforward input to be multiplied is closer to the feedforward phase angle for two interpolation coefficients determined such that the typical angle of the feedforward input to be multiplied is closer to the feedforward phase angle among the four types of interpolation coefficients. Values of two remaining interpolation coefficients among the four interpolation coefficients are zeroed.

The interpolation coefficients $\alpha_i$ thus determined are multiplied respectively by the corresponding feedforward inputs $u_{ILCi}$ and are all added as shown in the following Equation 2:

$$u_{ffw} = \sum_{i=1}^{4} \alpha_i u_{ILCi} \quad (2)$$

That is, the interpolation calculating portion 19 sets such that the value of one interpolation coefficient $\alpha_i$ is greater than the value of the other interpolation coefficient, one interpolation coefficient being determined such that the typical angle of the feedforward input to be multiplied is closer to the phase angle $\phi_t$ of the periodic disturbance $d_d$ estimated by the phase angle estimating portion 14, for feedforward inputs corresponding to the two typical angles closer to the phase angle $\phi_t$ of the periodic disturbance $d_d$ estimated by the phase angle estimating portion 14 among the four types of typical angles $\phi_i$. Meanwhile, the interpolation calculating portion 19 multiplies the feedforward inputs corresponding to the other two typical angles respectively by the interpolation coefficient $\alpha_i$ of zero. Then, the interpolation calculating portion 19 adds them and adds their total to the shift control circuit 11 from the adding portion 20 as an output $u_{ffw}$ calculated in the interpolation calculating portion 19. It is noted that such method for determining the typical angles $\phi_i$ and the method for determining the feedforward inputs $u_{ILCi}$ corresponding to that will be explained by numerical examples described later.

Figure 4:
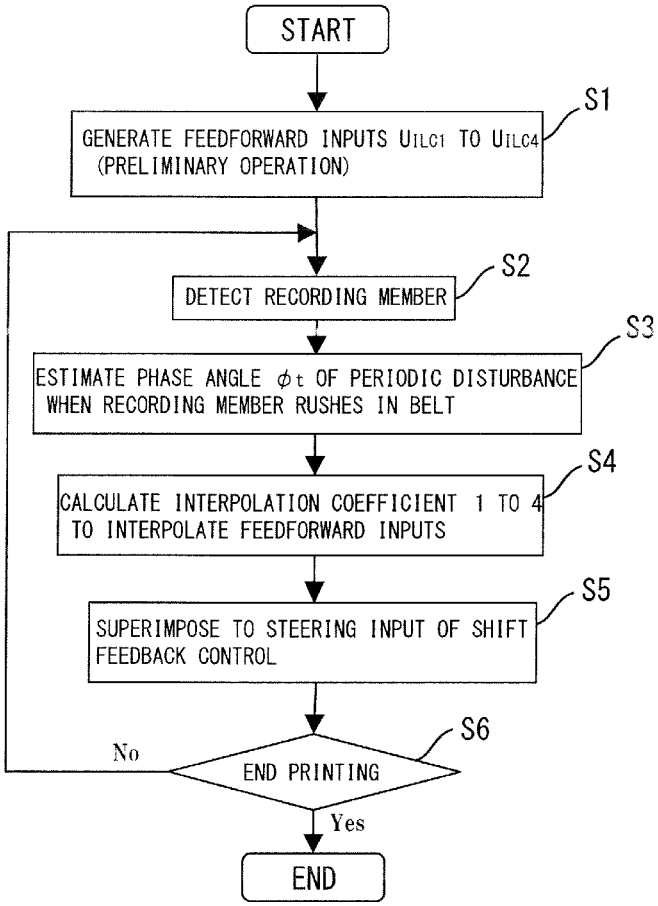
FIG. 4 is a flowchart showing a flow of steering control of the embodiment.

Such feedforward control will now be explained with reference to a flowchart in FIG. 4. At first, the feedforward inputs $u_{ILCi}$ (i=1 to 4) are generated by learning as a preliminary operation before printing operations by using iterative learning control described later in Step S1. Then, when a recording member is detected in Step S2, the phase angle $\phi_t$ of the periodic disturbance $d_d$ on the timing when the recording member rushes into the intermediate transfer belt is obtained by the estimation described above in Step S3. The interpolation coefficient $\alpha_i$ is determined from the estimated phase angle $\phi_t$ by using the above-mentioned Equation 1 and the feedforward inputs $u_{ILCi}$ are interpolated in Step S4. The interpolated output $u_{ffw}$ is added (superimposed) to the shift control circuit 11 in Step S5. That is, on the timing when the other disturbance is added to the belt 31, the interpolated output $u_{ffw}$ is added as a correction value to the control value of the feedback control. These processes are carried out until when the printing job ends in Step S6.

(Modeling)

Figure 5:
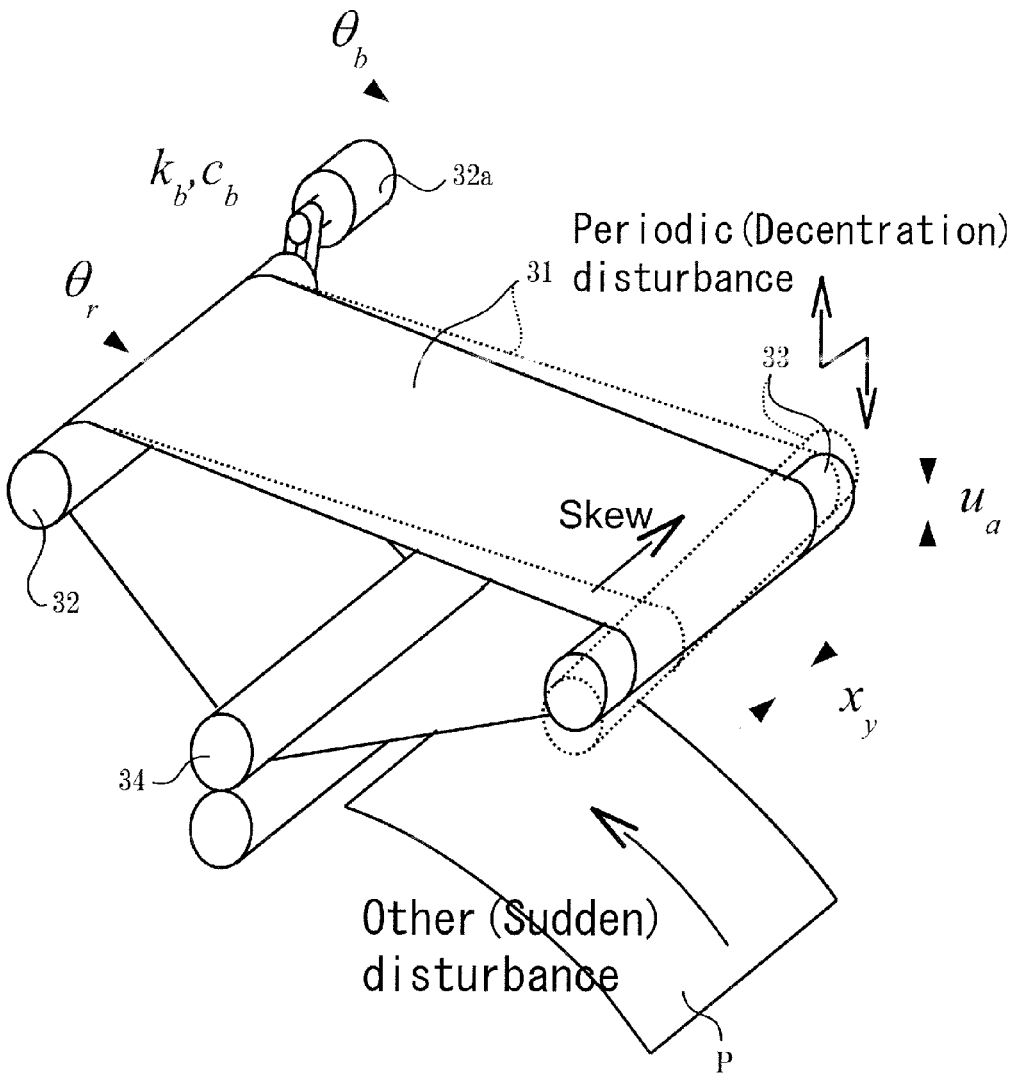
FIG. 5 is a perspective view schematically showing a structure of a belt driving unit of the embodiment.

Next, modeling of the belt shift motion for designing the feedforward control system will be explained with reference to FIG. 5 schematically showing a structure of a belt driving unit of the embodiment. A state system $P_y$ from a steering amount, i.e., a control input, to the widthwise position displacement, i.e., a controlled variable, will be derived, where the widthwise position displacement is $x_y$ and the steering amount is $u_a$. It is also assumed that the steering amount is determined uniquely by supposing that dynamic characteristics of a steering driving system is higher than dynamic characteristics of shift. When a radius of the drive roller 32 is denoted by Rn, shift speed can be expressed as follows:

$$\dot{x}_y=\alpha R_r\dot{\theta}_r u_a \quad (3)$$

Here, $\alpha$ is a constant and is experimentally identified by way of measuring the shift speed by traveling the belt such that the steering amount and the belt moving speed become constant. This may be expressed as a state equation as shown in Equation 4, and is expressed as a time-variant system $P_y(s)$ with respect to angular speed of the drive roller:

$$\dot{x}_y=[0]x_y+B_y(\dot{\theta}_r)u_a=A_yx_y+B_y(\theta_r)u_a$$

$$y_h=[1]x_y=C_yx_y \quad (4)$$

Still further, in order to use a simulation model having a linkage between the belt moving speed and the shift shown in FIG. 5 in the explanation and simulation of the design for the control system, the derivation thereof will be described below. Here, an angle of the drive roller 32 is denoted by $\theta_r$, an angle of the belt driving motor 32*a* by $\theta_b$, a spring constant and an attenuation constant between the drive roller 32 and the motor 32*a* by $k_b$ and $c_b$, respectively. A belt moving direction is assumed to be composed of two inertial systems of the drive roller 32 and the motor 32*a* in the simulation of the present embodiment. The intermediate transfer belt 31 is supposed to be a rigid body and no slip between the intermediate transfer belt 31 and the drive roller 32 is taken into account. Still further, the motor 32*a* is supposed to follow up and to be controlled accurately with angular speed proportional to a command voltage V by a motor controlling driver. Then, the angular speed of the motor 32*a* may be expressed by Equation 5:

$$\dot{\theta}_b = d_g V \tag{5}$$

Here, $d_g$ is a constant. Equations of motion of the two inertial systems composed of the motor 32*a* and the drive roller 32 turns out to be Equation 6, where inertia of the drive roller 32 is denoted by $I_r$:

$$I_r\ddot{\theta}_r + c_b(\dot{\theta}_r - \dot{\theta}_b) + k_b(\theta_r - \theta_b) = 0 \tag{6}$$

Here, when a state vector is expressed by Equation 7, and when a state equation is derived from Equations 5 and 6, the following Equation 8 holds:

$$x_r = [\theta_r\ \dot{\theta}_r\ \theta_b]^T \tag{7}$$

$$\begin{bmatrix} \dot{\theta}_r \\ \ddot{\theta}_r \\ \dot{\theta}_b \end{bmatrix} = \begin{bmatrix} 0 & 1 & 0 \\ \frac{-k_b}{I_r} & \frac{-c_b}{I_r} & \frac{k_b}{I_r} \\ 0 & 0 & 0 \end{bmatrix} \begin{bmatrix} \theta_r \\ \dot{\theta}_r \\ \theta_b \end{bmatrix} + \begin{bmatrix} 0 \\ \frac{\alpha c_b}{I_r} \\ d_g \end{bmatrix} V \tag{8}$$

When an observed output is the speed of the drive roller 32, the state and output equations hold by Equation 9:

$$\dot{x}_r = A_r x_r + B_r V$$

$$y_r = [010] x_r = C_r x_r \tag{9}$$

When the dynamic characteristic of the motor control driver is a quadratic lag system, the state equation holds as follows, where $u_b$ is command speed given to the motor control driver, $x_{f1}$ and $x_{f2}$ are quantities of state of the motor controlling driver:

$$\dot{x}_d = A_d x_d + B_d u_b,\ x_d = [x_{f1} x_{f2}]^T$$

$$V = C_d x_d \tag{10}$$

When Equation 10 is connected with Equation 9 in series by $X_h = [X_r\ X_d]^T$ to compose a spreading system, a model of the traveling direction is expressed by the following state equation:

$$\begin{aligned} \dot{x}_h &= \begin{bmatrix} A_r & B_r C_d \\ 0 & A_d \end{bmatrix} x_h + \begin{bmatrix} 0 \\ B_d \end{bmatrix} u_b \\ &= A_h x_h + B_h u_a \end{aligned} \tag{11}$$

$$\begin{aligned} y_h &= [\ C_r\ \ 0\ ] x_h \\ &= C_h x_h \end{aligned} \tag{12}$$

Here, a model of linkage between traveling and shift of the belt can be obtained by composing a spreading system by the shift direction model formula (3) and the belt driving direction model formula (12). Its state equation is obtained as follows:

$$\begin{bmatrix} \dot{\theta}_r \\ \ddot{\theta}_r \\ \dot{\theta}_b \\ \dot{x}_{f1} \\ \dot{x}_{f2} \\ \dot{x}_y \end{bmatrix} = \left[\begin{array}{c|c} A_h & 0 \\ \hline 0 & 0 \end{array}\right] \begin{bmatrix} \theta_r \\ \theta_r \\ \theta_b \\ x_{f1} \\ x_{f2} \\ x_y \end{bmatrix} + \left[\begin{array}{c|c} B_h & 0 \\ \hline 0 & aR_r\dot{\theta}_r \end{array}\right] [u_b\ \ u_a]^T \tag{13}$$

(Design for Control System)

Next, the design for the feedback control system for the belt moving speed and shift motion will be explained. In order to compensate an integration of displacements of the belt traveling direction, a feedback controller $K_h$ of the belt moving direction is adapted to be the following two-type servo system:

$$K_h(s) = 250\left(1 + \frac{40 \cdot 2 \cdot \pi}{s} + \frac{s}{60 \cdot 2 \cdot \pi} + \frac{(10 \cdot 2 \cdot \pi)^2}{s^2}\right) \tag{14}$$

A shift feedback controller $K_y$ uses a sliding mode control system. Control inputs are composed of a linear input and a non-linear input, and are expressed by the following Equation 15. Here, σ is a changeover function and is expressed by the following Equation 16, where S=560.22, $k_o$=2, and η=0.3 in the present embodiment:

$$u_b = -(SB_y)^{-1} SA_y x_y - k_o (SB_y)^{-1} \frac{\sigma}{\|\sigma\| + \eta} \tag{15}$$

$$\sigma = S x_y \tag{16}$$

(Determination of Typical Angle)

Figure 6:
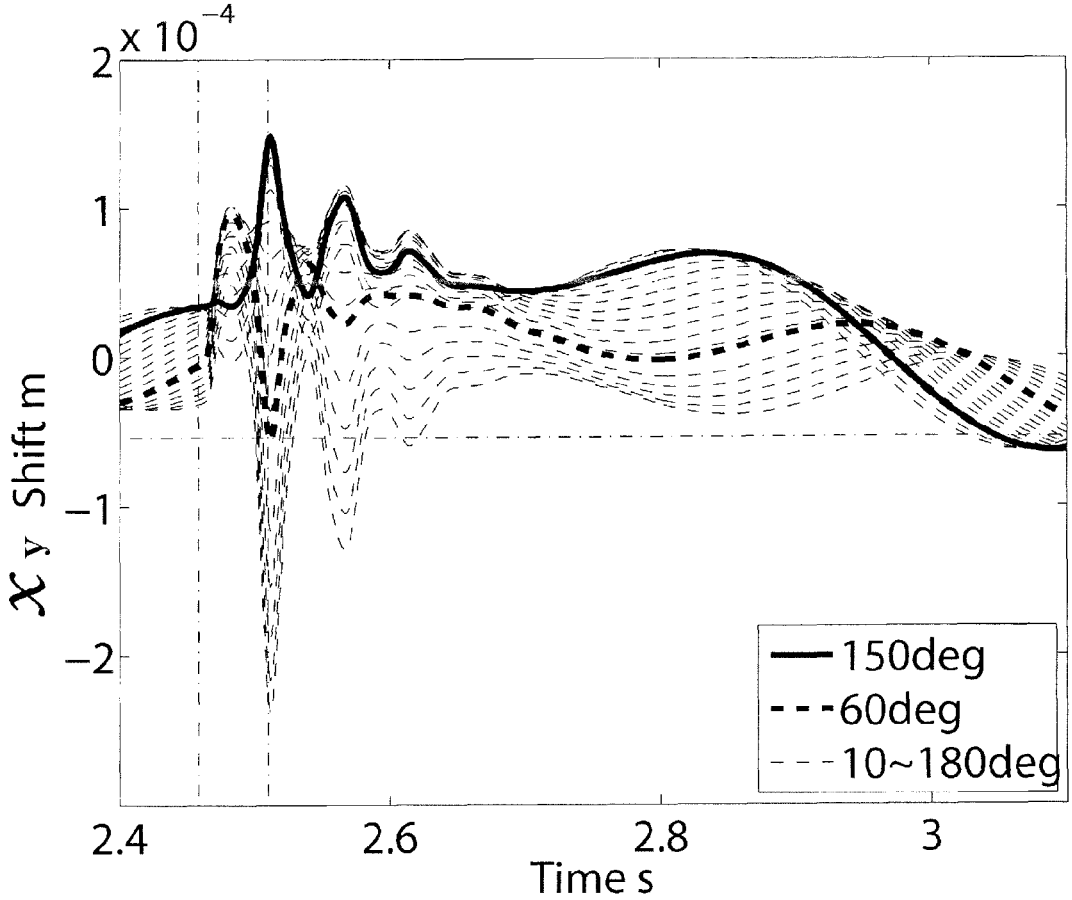
FIG. 6 is a chart indicating a widthwise position displacements with respect to time when a simulation of inrush of a recording member implemented by changing phase angles of a periodic disturbance is made.
Figure 7:
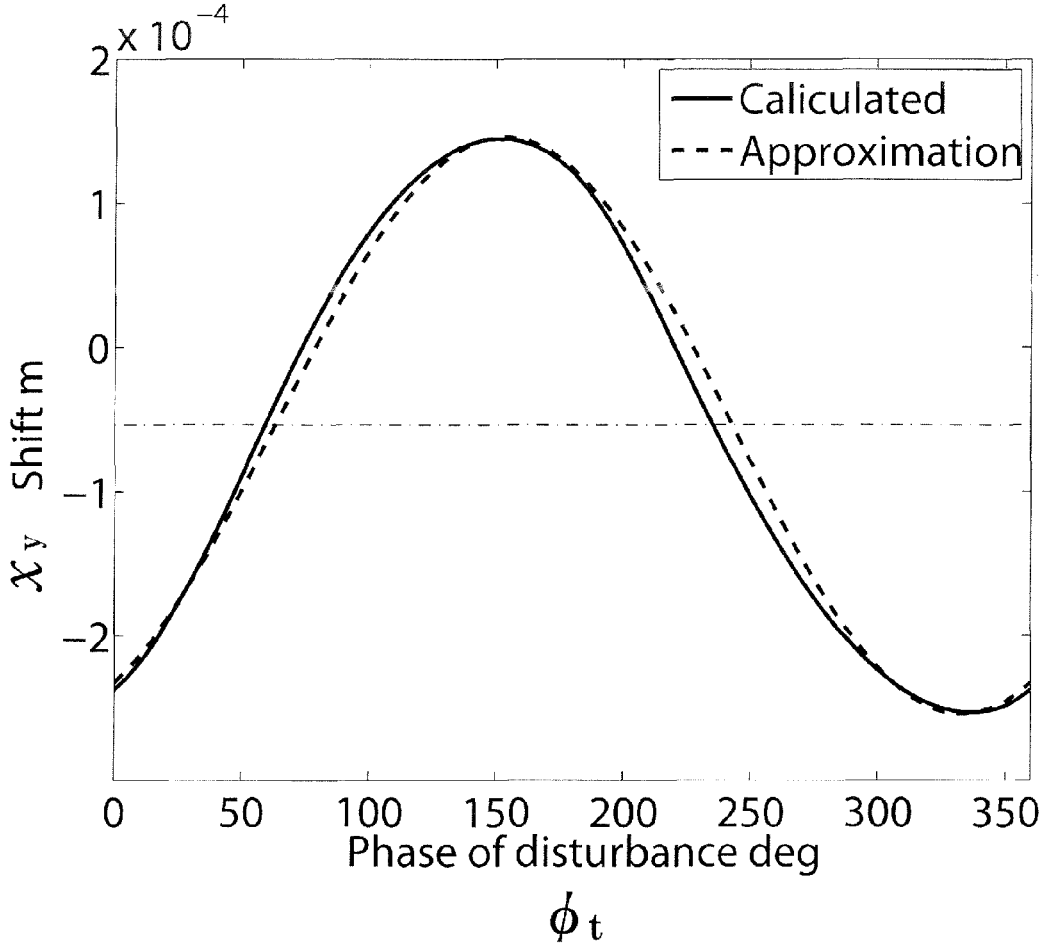
FIG. 7 is a chart indicating a relationship between the phase angle of the periodic disturbance and a maximum value of the widthwise position displacement at that phase angle obtained from the simulation shown in FIG. 6.
Figure 8:
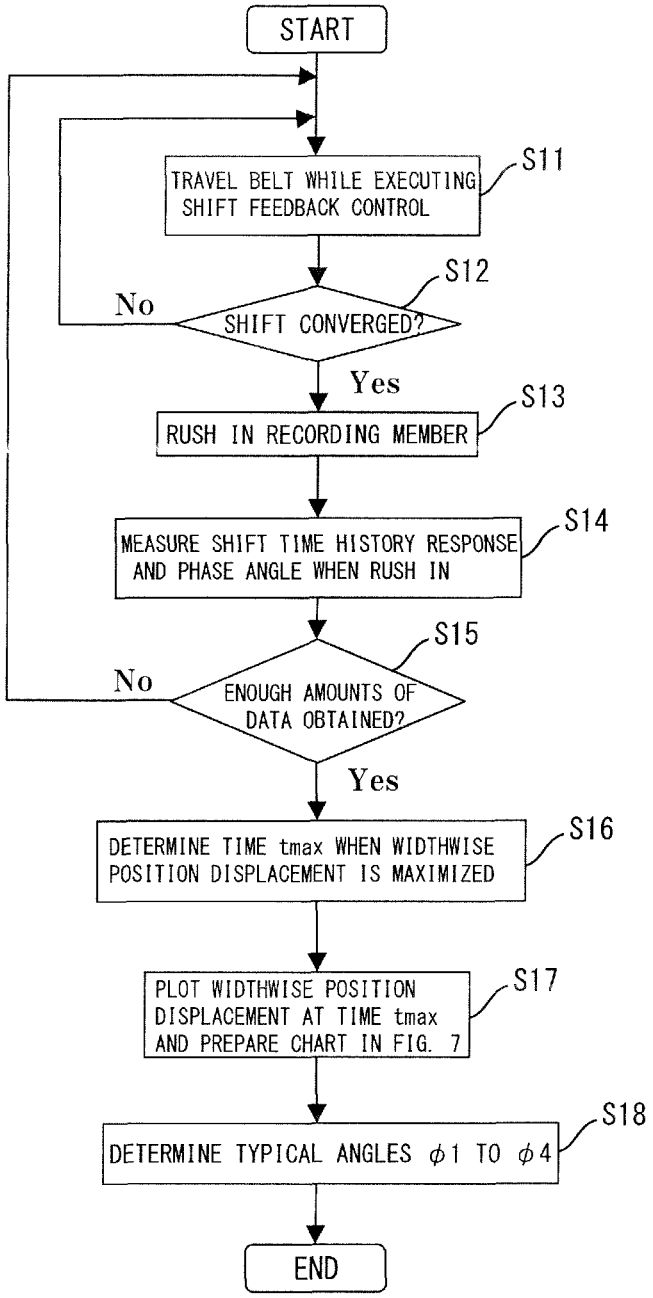
FIG. 8 is a flowchart showing a flow for determining four types of phase angles (typical angles) of the periodic disturbance set in advance.

Next, a design for an interpolated feedforward control system will be explained with reference to FIGS. 6 through 8. The CPU 211 functions as the typical angle determining portion by executing the typical angle determining program 225B described above, and determines the typical angles $\phi_i$ (i=1 to 4), i.e., the four types of phase angles of the periodic disturbance, as follows. At first, the other disturbance caused by the inrush of the recording member is added to the intermediate transfer belt 31 at a plurality of, more than four types and each different types of, phase angles of the periodic disturbance, e.g., per 10 degrees of 10 to 180 degrees. Next, the CPU 211 obtains changes of the widthwise position displacements (control values of the shift control circuit 11) $x_y$ with respect to time in these cases as shown in FIG. 6. Then, the CPU 211 obtains a relationship between the plurality of phase angles (10 to 180 degrees) of the periodic disturbance and the widthwise position displacement $X_y$ at a time $t_{max}$ when the widthwise position displacement $X_y$ is maximized as shown in FIG. 7. Then from the relationship shown in FIG. 7, the CPU 211 determines a phase angle where the widthwise position displacement $x_y$ is maximized, a phase angle where the widthwise position displacement $x_y$ is minimized, and two phase angles which are medians of the widthwise position displacements $x_y$ as the typical angles $\phi_i$ (i=1 to 4). This process will be explained specifically below.

FIG. 6 shows responses of the widthwise position displacements obtained when the simulation of the inrush of the recording member was carried out by defining the periodic disturbance $d_d$ as a sine wave having frequency $\omega_d=2.441\cdot 2\cdot\pi$ and a phase angle $\phi$ as shown in the following Equation 17 and by using Equation 13:

$$d_d=\sin(\overline{\omega}_d t+\phi) \quad (17)$$

Assuming here that the recording member rushes into the secondary transfer portion on a sixth period of the periodic disturbance, a step-like disturbance is given as the disturbance $d_{ph}$ caused by the inrush of the recording member with respect to the belt moving speed, and a sinusoidal disturbance of only one period is given as the disturbance $d_{py}$ caused by the inrush of the recording member with respect to the shift. Still further, the phase angle $\phi_t$ of the periodic disturbance $d_d$ at the time of the inrush of the recording member is changed per 10 degrees from 10 degrees to 180 degrees.

It can be seen from FIG. 6 that even if the disturbances $d_{ph}$ and $d_{py}$ caused by the recording member are constant, the response of the shift, i.e., the control value of the shift control circuit 11 or the widthwise position displacement $x_y$, varies depending on the phase angle $\phi_t$ of the periodic disturbance $d_d$ at the time of the inrush of the recording member. Therefore, it will do just by generating and storing a feedforward input per phase angle in the memory in order to design the feedforward control system that suppresses the shift of the belt caused by the disturbance of the inrush of the recording member. However, this arrangement consumes much memory for accumulating the feedforward inputs as described above. Then, a feedforward control system that suppresses the consumption of the memory will be constructed in the present embodiment.

It is noted in FIG. 6 that after the inrush of the recording member, the widthwise position displacement $x_y$, i.e., the control value of the shift control circuit 11, is maximized around a time $t_{max}$=2.51 seconds. Then, FIG. 7 shows the response whose phase angle $\phi_t$ at the point of time when the disturbance caused by the inrush of the recording member is applied is represented by an axis of abscissa, and whose widthwise position displacement $x_y$ maximized at 2.51 seconds is represented by an axis of ordinate. A solid line indicates the response obtained by the simulation, and a broken line indicates the response approximated by a sine wave. It can be seen from FIG. 7 that the maximum value of the widthwise position displacement $x_y$ is a periodic response with respect to the phase angle $\phi_t$. Then, a phase angle $\phi_1$ where the periodic disturbance $x_y$, i.e., the control value of the shift control circuit 11, is maximized in a positive direction, a phase angle $\phi_3$ where the widthwise position displacement $x_y$ is maximized in a negative direction, and phase angles $\phi_2$ and $\phi_4$ which are medians (indicated by one-dot chain line in FIG. 7) of the periodic response to the phase angles $\phi_t$ of the widthwise position displacement $x_y$ around 2.51 seconds are defined as the typical angles in the present embodiment. That is, these phase angles $\phi_1$, $\phi_2$, $\phi_3$, and $\phi_4$ are the typical angles in the present embodiment. From FIG. 7, these typical angles take the following values: $\phi_1$=155 deg., $\phi_2$=60 deg., $\phi_3$=335 deg., and $\phi_4$=235 deg.

While $t_{max}$ and $\phi_i$ (i=1 to 4) have been obtained by using the model of Equation 13 so far, they may be obtained by using an actual device and by mapping the relationship of the maximum value of the widthwise position displacement $x_y$ and the phase angles $\phi_t$ in FIG. 7. A flowchart in FIG. 8 shows this procedure. At first, the belt is traveled while implementing the shift feedback control in Step S11, and it is confirmed when the widthwise position displacement is zeroed (converged) by the feedback control of Equation 14 in Step S12. Then, the recording member is rushed into the secondary transfer portion in Step S13 to measure a time history response of the shift caused by the inrush of the recording member and the phase angle $\phi_t$ of the periodic disturbance at the time of the inrush in Step S14. A chart as shown in FIG. 6 is prepared experimentally by repeating these steps to obtain data until when any deviation in a distribution of the phase angle $\phi_t$ is vanished in Step S15. The time $t_{max}$ when the widthwise position displacement $x_y$ is maximized is determined from the chart in FIG. 6 experimentally prepared in Step S16. Next, a chart as shown in FIG. 7 is prepared from the experimental data by processing the data and mapping by representing $\phi_t$ by an axis of abscissa and the widthwise position displacement $x_y$ at the time $t_{max}$ when the recording member is rushed into the secondary transfer portion T2 at the phase angle $\phi_t$ by an axis of ordinate in Step S17. Then, the typical angle $\phi_i$ (i=1 to 4) is read from the chart in FIG. 7 in Step S18.

That is, the four types of typical angles of the periodic disturbance are a phase angle where the control value is maximized, a phase angle where the control value is minimized, and two phase angles which are medians of the control values, wherein these four types of phase angles are determined from a relationship between more than four types of phase angles of the periodic disturbance and their control values of the feedback control at a time when a variation of the control values with respect to time is maximized when the other disturbance is caused in the belt 31 which is feedback controlled by rushing the recording member into the nip portion (secondary transfer portion) T2 at the more than four types of phase angles.

(Generation of Feedforward Input)

The feedforward input $u_{ILCi}$ (i=1 to 4) for optimally suppressing the shift motion generated when the recording member rushes into the belt at the typical angles $\phi_i$ (i=1 to 4) thus determined are generated by the CPU 211 by executing the feedforward generating program 225C. Operations for generating the feedforward inputs using iterative learning control when the feedforward generating program 225C is executed will now be described.

The iterative learning control is an operation for reducing a deviation from a target value by repeating follow-up controls to the target value by using an actual device. For instance, it is necessary to repeat trials of inserting the recording member such that the phase angle of the periodic disturbance becomes the typical angle $\phi_1$ on the timing of the inrush of the recording member to obtain the feedforward input $u_{ILCi}$. In the same manner, the feedforward input $u_{ILCi}$=2 to 4) corresponding to $\phi_i$ (i=2 to 4) is learnt by repeating trials of inserting the recording member such that the phase angle of the periodic disturbance becomes the typical angle $\phi_i$ (i=2 to 4) on the timing of the inrush of the recording member.

Figure 9:
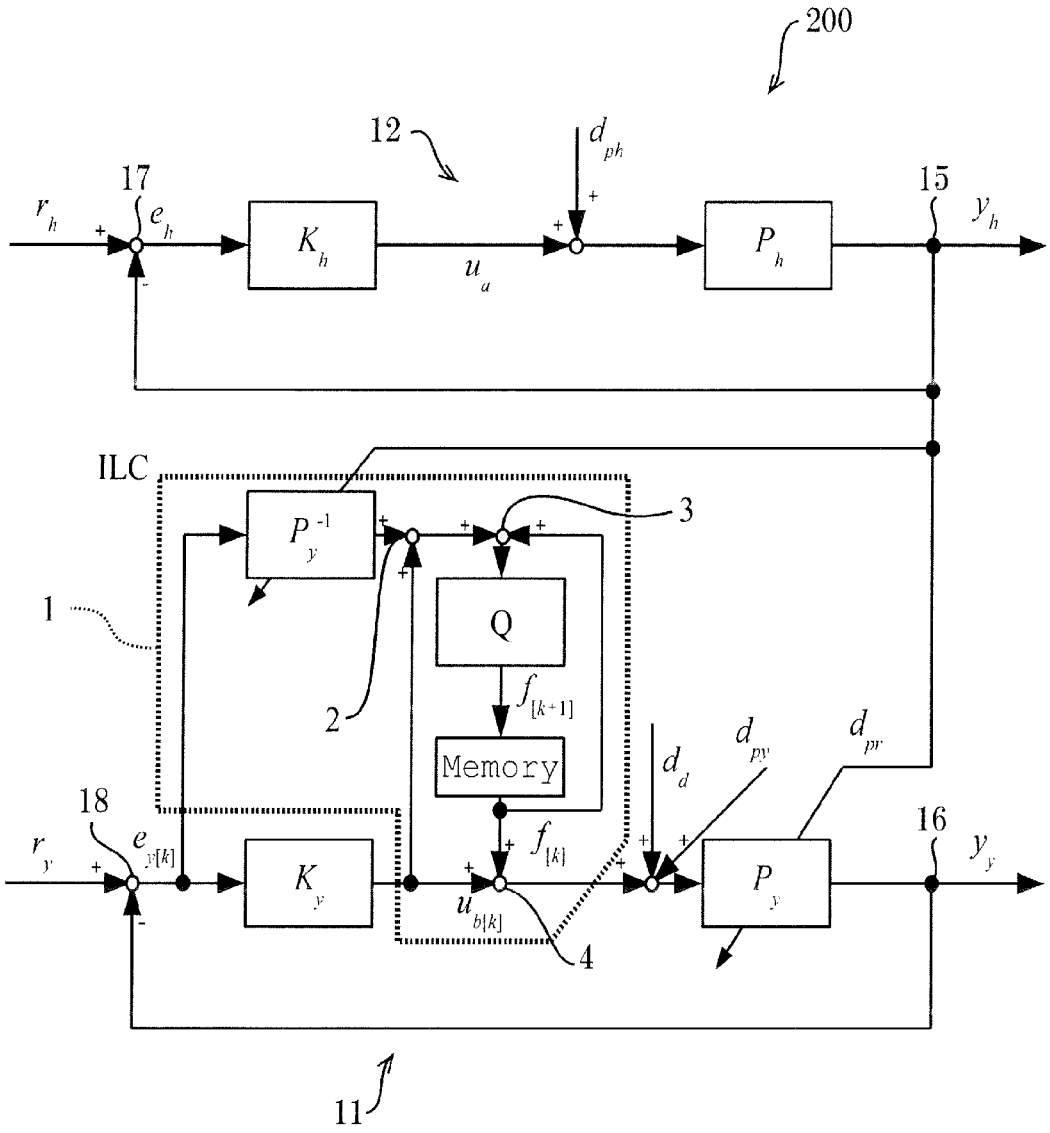
FIG. 9 is a block diagram of iterative learning control for generating feedforward inputs corresponding to the typical angles.

In order to perform such iterative learning control, the CPU 211 of the control apparatus 200 of the present embodiment functions also as an iterative learning control circuit 1 as shown in FIG. 9. The iterative learning control circuit 1 has a filtering circuit containing an inverse system $P_y^{-1}$ and a filter output adding portion 4. The inverse system $P_y^{-1}$ is an inverse system of the state system $P_y(s)$ from the control input (steering amount) of the shift control circuit 11 to the controlled variable (widthwise position displacement), and a deviation $e_{y[k]}$ between a numerical value $y_y$ fed back in the shift control circuit 11 and a target value $r_y$ is input. It is noted that k is a number of times of iteration. The filter output adding portion 4 adds an output of the filtering circuit described above to the shift control circuit 11. Based on the result of the iterative learning control of the iterative learning control circuit 1, the memory (see FIG. 3) stores the outputs of the filtering circuit in which the deviation $e_{y[k]}$ is minimized respectively as feedforward inputs. The iterative learning control circuit 1 executes the iterative learning control based on the disturbances caused in the intermediate transfer belt 31 by inrushing the recording member by a plurality of times when the phase angle of the periodic disturbance is the phase angle $\phi_i$ (i=1 to 4) of the periodic disturbance set in advance. This control will be explained specifically below.

Because the target value $r_y$ of the widthwise position is zero, the feedforward inputs for suppressing the deviation caused by the other disturbance is generated by iterative trials by the iterative learning control in the present embodiment. As shown in FIG. 9, the iterative learning control circuit 1 includes the inverse system $P_y^{-1}$ that generates a control input from a control deviation $e_{y[k]}$ ($k^{-th}$ deviation), a stabilization filter Q that cuts off frequency bands unnecessary for learning of the inverse system $P_y^{-1}$, and a memory for storing the generated control input. The memory is the memory 21 shown in FIG. 3. The control input finally generated is stored in the memory 21 as the feedforward input.

The deviation $e_{y[k]}$ is input to the inverse system $P_y^{-1}$ and its output is input to the adding portion 2. A $k^{-th}$ shift feedback control input $u_{b[k]}$ is also input to the adding portion 2. An output of the adding portion 2 and the control input $f_{[k]}$ of the $k^{-th}$ iterative learning control are input to the adding portion 3. An output from the adding portion 3 is input to the stabilization filter Q. An output of the stabilization filter Q is stored in the memory as a $k+1^{-th}$ control input $f_{[k+1]}$. The control input $f_{[k+1]}$ stored in the memory is added to control objects as the feedforward input in a $k+1^{-th}$ follow-up control. That is, it is added to an output $u_{b[k+1]}$ of the feedback controller $K_y$ of the shift control circuit 11. Still further, the inverse system $P_y^{-1}$ is a time-varying system dependent on rotational angular speed $\dot{\theta}$ of the roller in the present embodiment. The inverse system $P_y^{-1}$ is derived by connecting a low pass filter for making it proper in series to an inverse transfer function in Equation 4 by the following Equation 18:

$$P_y(s)^{-1} = \frac{s}{aR_r\dot{\theta}_r} \cdot \frac{1}{s/(400 \cdot 2\pi) + 1} \tag{18}$$

The stabilization filter Q is a low pass filter whose cutoff frequency is 6 Hz and whose order is 6. Next, a flow of the iterative learning control will be explained with reference to FIG. 10. At first, an initial trial is made without using the input of the iterative learning control in Steps S21 and S22. A $k^{-th}$ iterative trial after that is made by using the control input $f_{[k]}$. Because the control is made by way of digital control, a control input and a deviation of a th sample in the $k^{-th}$ trial will be denoted by $f_{kj}$ and $e_{kj}$, respectively. In the same manner, a feedback control input of the $j^{-th}$ sample in the $k^{-th}$ trial will be denoted by $u_{kj}$.

Figure 10:
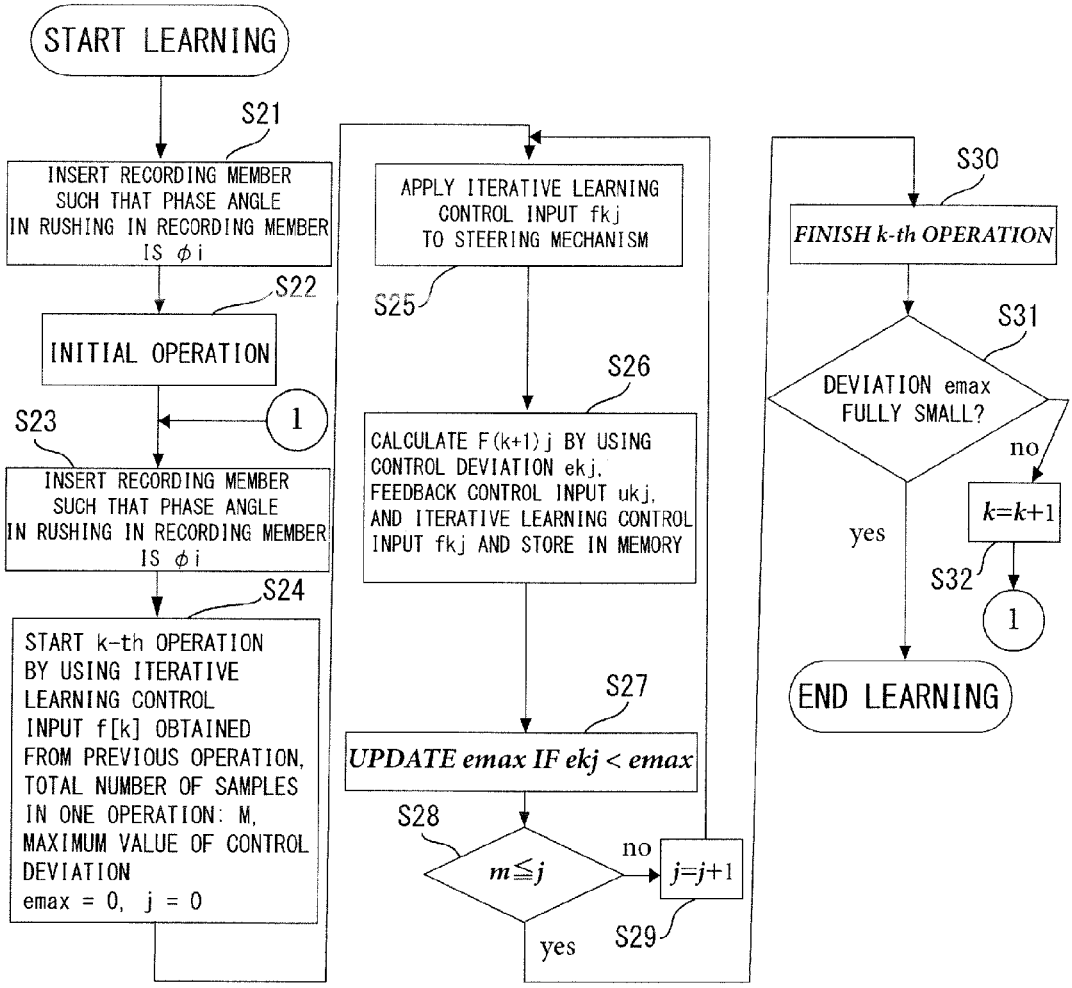
FIG. 10 is a flowchart of the iterative learning control.

The flowchart as shown in FIG. 10 is implemented in a computer of the image forming apparatus by being programmed as an iterative learning control algorithm. The feedforward generating program 225C causes the control apparatus 200 to generate a signal for inserting a recording member such that phase angles at the time of the inrush of the recording member to the secondary transfer portion are $\phi_i$ (i=1 to 4) in Step S23. Next, the control apparatus 200 starts a $k^{-th}$ operation by using the iterative learning control input $f_{[k]}$ obtained by the previous operation and obtains a maximum value $e_{max}$ of a control deviation within a total number of samples (m) in one operation in Step S24. In an initial operation, $e_{max}$ and j are zero. Then, the control apparatus 200 applies the control input $f_{kj}$ to the steering mechanism 33*a* on the timing of the inrush of the recording member in Step S25 to obtain a deviation $e_{kj}$ at that time. After passing the control deviation $e_{kj}$ through a learning filter and adding with the feedback control input $u_{kj}$, it is added with the iterative learning control input $f_{kj}$. A result obtained after passing this signal through the stabilization filter Q is stored in the memory as a $k+1^{-th}$ iterative learning control input $f_{(k+1)j}$ in Step S26. Then, the iterative trials are carried out until when the maximum value $e_{max}$ of the control deviation in one trial is fully lessened.

That is, if the control deviation $e_{kj}$ when the control input $f_{kj}$ is applied is smaller than the previous value $e_{max}$, the control deviation $e_{kj}$ is updated as a new value $e_{max}$ in Step S27. This process is carried out until when the number of samples j reaches the total number of samples (m) in Steps S28 and 29. When the number of samples reaches (m), a $k^{-th}$ operation is finished in Step S30. Then, it is judged whether $e_{max}$ is fully small, e.g., whether it is zeroed, in Step S31. If $e_{max}$ is not fully small, a $k+1^{-th}$ operation is carried in Step S32, and if $e_{max}$ is fully small, the learning is finished. Such iterative leaning operations are carried out on all of the typical angles $\phi_i$ (i=1 to 4), and the iterative learning control inputs $f_{[k]}$ when $e_{max}$ is fully small, respectively, are stored in the memory as the feedforward inputs $u_{ILCi}$ (i=1 to 4).

In other words, the CPU 211 obtains the deviation from the target value of the widthwise position of the belt 31 by causing the other disturbance to the belt 31 which is feedback controlled when the phase angles of the periodic disturbance are the typical angles, obtains the control values of the steering mechanism 30 calculated such that the deviation is compensated based on the deviation of the widthwise position of the belt 31, repeats the control of the belt 31 on which the other disturbance is caused when the phase angles of the periodic disturbance are the typical angles by using the calculated control value to determine the control value by which the deviation of the belt 31 is minimized, obtains the values of feedforward inputs corresponding to the respective typical angles based on the determined control value, and, based on the control value thus determined, stores the values in the memory. The CPU 211 obtains the values of the feedforward inputs $u_{ILCi}$ (i=1 to 4) corresponding to the respective typical angles and stored in the memory 21.

The feedforward inputs $u_{ILCi}$ corresponding to the four types of phase angle $\phi_i$ of the periodic disturbance $d_d$ set in advance are interpolated based on the phase angles at which the disturbance caused by the inrush of the recording member is added, and are added to the shift control circuit 11 in the present embodiment. Accordingly, it is possible to stably control the operations even if the disturbance caused by the inrush of the recording member is added to the control system that controls the periodic disturbance without requiring a large amount of memory capacities.

(Simulation)

Figure 11A:
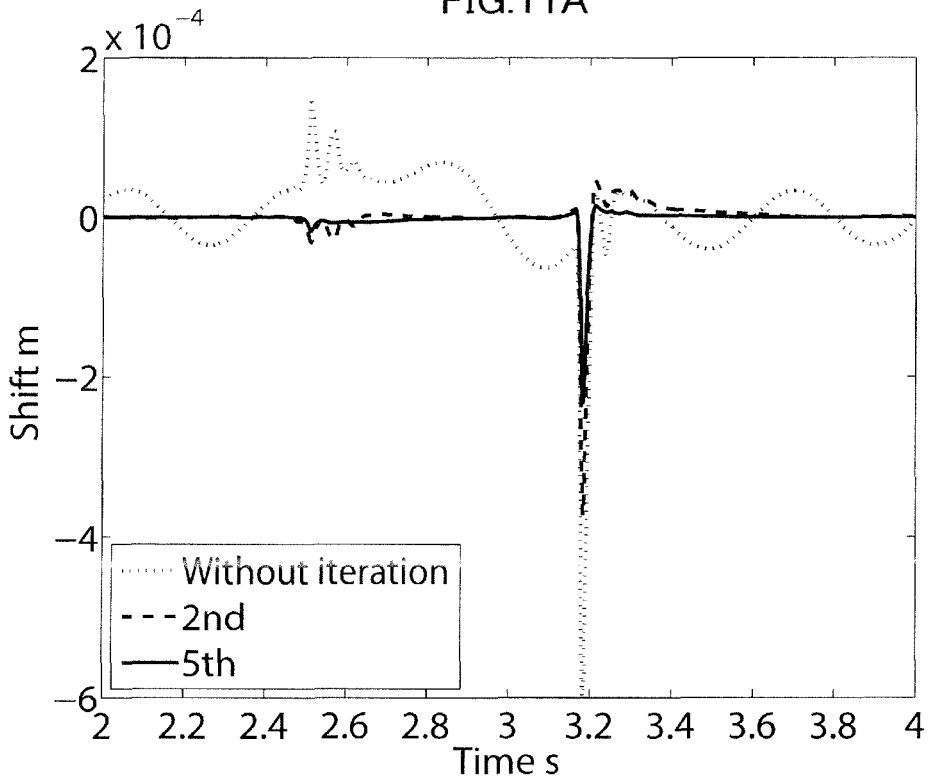
FIGS. 11A and 11B are charts showing two exemplary simulation results of the iterative learning control concerning the widthwise position displacement with respect to time in the respective iteration numbers of times.

The simulations carried out for the present embodiment will now be explained. Firstly, effectiveness of the iterative learning control for the typical angle will be explained. FIG. 11A shows responses obtained in a process of learning the feedforward input $u_{ILC1}$ corresponding to the phase angle $\phi_1$ of the periodic disturbance by using the simulation model of Equation 13. A dot line indicates a response of shift in the initial trial, i.e., a response without input of learning, a broke line indicates a response of shift in a second iterative trial, and a solid line indicates a response of shift in a fifth iterative trial. Thus, it can be seen that the deviation of the widthwise position caused by the inrush of the recording member is suppressed by the input of learning, i.e., by repeating the trials of the inrush of the recording member.

Figure 11B:
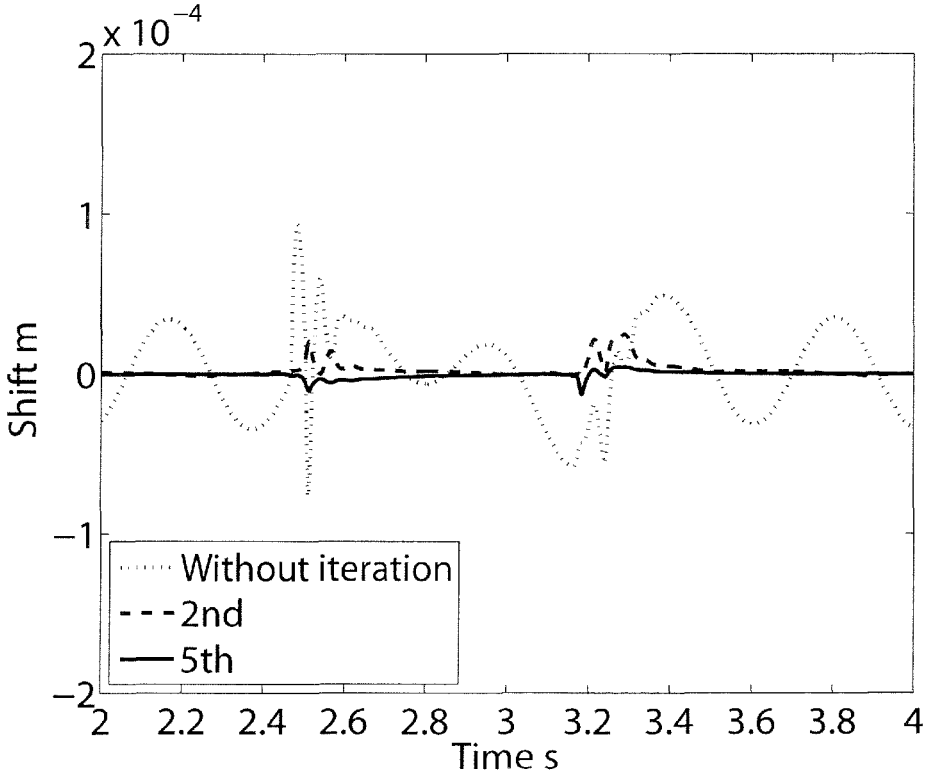

FIG. 11B shows responses in the process of learning a feedforward input $u_{ILC2}$ corresponding to a phase angle $\phi_2$ of the periodic disturbance. Similarly to the case of FIG. 11A, it can be seen that the deviation of the widthwise position is suppressed by learning five times. The feedforward inputs $u_{ILC3}$ and $u_{ILC4}$ corresponding to the phase angles $\phi_3$ and $\phi_4$ of the periodic disturbance are also learnt in the same procedure, and the effectiveness of the learning is confirmed.

Next, an effectiveness of the interpolated feedforward control system in FIG. 3 using the iterative learning control input at the typical angles will be confirmed by simulations. The simulations are carried out by assuming that inrushes of recording members of 70 sheets per minute occur. Timings of the inrushes of the recording members are detected by the detecting portion 13 and the phase angle estimating portion 14 in FIG. 3, and it is arranged to be able to detect the phase angle of the periodic disturbance $d_d$ at that time by attaching a rotary encoder or the like to the roller which is the largest factor of the periodic disturbance. Still further, a comparison with the variable gain method is made in the simulation. The shift feedback control system is multiplied by a gain $G_v$ (see Equation 19 below) which is a function of the belt moving speed in the variable gain method:

$$Gv = \frac{V_n}{\dot{\theta}_r} \tag{19}$$

Figure 12A:
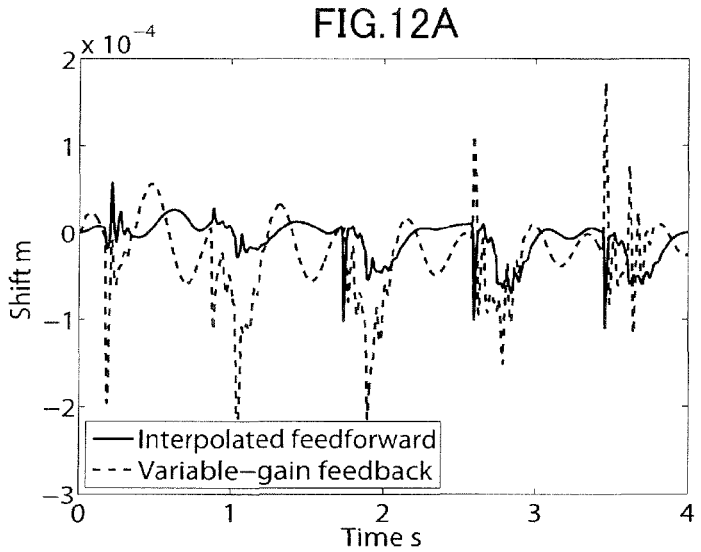
FIGS. 12A, 12B and 12C are charts respectively showing the simulation results made to verify effects of the embodiment, wherein FIG. 12A indicates a response of the widthwise position displacement, and FIG. 12B indicates a response of a steering amount, both in comparison with a variable gain method, and FIG. 12C indicates a response of the widthwise position displacement in comparison with a fixed feed-forward control system.
Figure 12B:
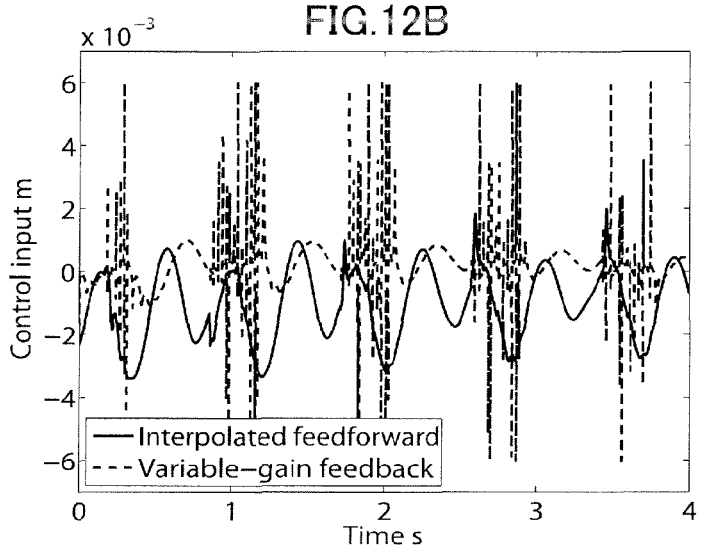

Here, a constant $v_n$ is angular speed of the drive roller when the belt moving speed is reference speed. In FIG. 12A, a solid line indicates a response of a widthwise position displacement obtained by the control system of the present embodiment, and a broken line indicates a response of a widthwise position displacement obtained by the variable gain method. FIG. 12B shows responses of steering amounts of shift control obtained by the control system of the present embodiment and of the variable gain method. While the phase angles of the periodic disturbance on the timing of the inrush of the recording member differ every time, the control system of the present embodiment can suppress the deviation of the widthwise position as compared to the variable gain method by implementing the feedforward control to the disturbance caused by the inrush of the recording member by using Equations 1 and 2. It can be also seen from FIG. 12B that the steering amount does not become excessive because the gain of the feedback control system is fixed in the control system of the present embodiment. However, the variable gain method considerably increases the steering amount as indicated by a broken line in FIG. 12B because a shift feedback control gain increases high when belt traveling speed becomes late due to the inrush of the recording member as can be seen from Equation 19.

Figure 12C:
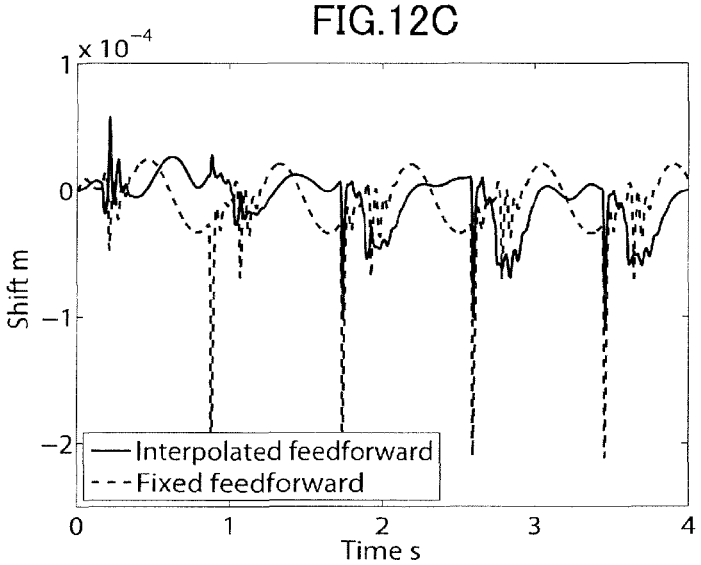

Next, a comparison is made with a feedforward control system that learns a deviation of a widthwise position by the iterative learning control in a condition in which no inrush of a recording member occurs and that uses the feedforward input thus obtained in a condition in which the inrush of the recording member occurs. This control system will be referred to as a fixed feedforward control system hereinafter. In FIG. 12C, a solid line indicates a response of a widthwise position displacement obtained by the interpolated feedforward control system of the present embodiment, and a broken line indicates a response of a widthwise position displacement obtained by the fixed feedforward control system. It can be seen from the chart in FIG. 12C that the fixed feedforward control system causes large deviations periodically on the timing of the inrush of the recording member because no suppression for the disturbance of the inrush of the recording member is taken into account.

It is noted that the simulations of the present embodiment have been carried out by assuming that there exists the single periodic disturbance. It has been then confirmed by simulations that if there exist a plurality of periodic disturbances, it will do by considering only the largest periodic disturbance if the second largest periodic disturbance has an amplitude of around 40% or less of that of the largest periodic disturbance.

<Second Embodiment>

While the CPU functions as the speed control circuit, the shift control circuit, the feedforward control circuit, the typical angle determining portion, the iterative learning control circuit and others by executing the belt control program, the typical angle determining program, the feedforward generating program, and others in the first embodiment described above, the second embodiment is different from the first embodiment in that a control apparatus is constructed by designing the various circuits described above as dedicated circuits.

Specifically, the speed control circuit, the shift control circuit, the feedforward control circuit, the typical angle determining portion, and the iterative learning control circuit are constructed by ASIC (Application Specific Integrated Circuit) in the second embodiment. The circuits described above may be also constructed by FPGA (Field-Programmable Gate Array) or the like. Further, it is also possible to let the CPU execute a part of the above circuit group by using programs.

<Third Embodiment>

While the four types of typical angles are set in the embodiments described above, the number of types of the typical angles may be an integer times of four, e.g., 8 and 16, for example. However, because much memory is consumed if a large number of typical angles are set, the number of types is set to be at least four in the present invention. Still further, although the invention has been applied to the tandem-type image forming apparatus in the embodiments described above, the invention is applicable to another image forming apparatus such as a monochrome image forming apparatus having one image forming portion. The belt unit is applicable not only to the apparatus related to the intermediate transfer belt, but also to an apparatus that makes belt shift control such as a fixing apparatus having a fixing belt (moving member) that heats a recording member for example. The control as described above is effective in controlling the belt when a recording member rushes into a nip portion between the fixing belt and a press member such as pressure roller. The control apparatus of the invention is applicable also to a moving member, other than the belt unit, which is driven in a condition having a periodic disturbance and to which a disturbance other than the periodic disturbance is added. The typical angle determining program 225B and the feedforward generating program 225C need not be always stored in the memory 21 of the image forming apparatus, and may be built in a driver of a computer on a production facility side of the image forming apparatus. In this case, the computer 340 on the production facility side connected to the image forming apparatus executes the determination of the typical angles and the generation of the feedforward inputs, and the feedforward inputs as a result thereof are stored in the memory 21 of the image forming apparatus.

It is also possible to provide the driver 225 through a communication line such as Internet by using the communication unit 131 for example. It is also possible to record the driver 225 in a non-temporary and computer readable recording medium such as a CD and a DVD, other than the memory, and to store in the memory 21 of the image forming apparatus through an external computer.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-1117000, filed on May 15, 2012, which is hereby incorporated by reference herein in its entirety.

What is claimed is:

1. A method for controlling a driving condition of an endless belt driven in a condition having a periodic disturbance and an other disturbance other than the periodic disturbance, comprising steps of:

feedback controlling a widthwise position of the belt by a steering mechanism that is configured to move the belt in the widthwise direction such that an influence of the periodic disturbance is compensated;

estimating or detecting a phase angle of the periodic disturbance on the timing when the other disturbance is added to the belt in response to detecting that the other disturbance is to be added during the feedback control;

obtaining interpolation coefficients that respectively interpolate values of feedforward inputs when the other disturbance is added in case of a plurality of typical angles set in advance among phase angles of the periodic disturbance stored in a memory based on the estimated or detected phase angles of the periodic disturbance and adding values obtained by multiplying these interpolation coefficients by the values of the corresponding feedforward inputs; and controlling the steering mechanism by adding the values obtained by multiplying the interpolation coefficients by the values of the corresponding feedforward inputs to control values of the feedback control as a correction value, wherein the plurality of typical angles are four types of phase angles of the periodic disturbance determined by a phase angle where the control value is maximized, a phase angle where the control value is minimized, and two phase angles which are medians of the control values from a relationship between more than four types of phase angles of the periodic disturbance and their control values of the feedback control at a time when a variation of the control values with respect to time is maximized when the other disturbance is caused in the belt which is feedback controlled by rushing the recording member into the nip portion at the more than four types of phase angles, and the values of feedforward inputs are values of four feedforward inputs corresponding to the four typical angles, and each feedforward input is obtained by obtaining a deviation from a target value of the widthwise position of the belt by causing the other disturbance to the belt which is feedback controlled when the phase angle of the periodic disturbance is the corresponding typical angle, obtaining a control value of the steering mechanism calculated such that the deviation is compensated based on the deviation of the widthwise position of the belt, repeating the control of the belt on which the other disturbance is caused when the phase angle of the periodic disturbance is the corresponding typical angle by using the calculated control value, determining a control value by which the deviation of the widthwise position of the belt is minimized, and obtaining the values of feedforward inputs based on the determined control value.

2. The method for controlling the driving condition of the belt according to claim 1, wherein the belt is an intermediate transfer belt which is wrapped around and driven by a drive roller, on which an image formed in an image forming portion is transferred in a primary transfer portion, and whose transferred image is transferred to a recording member in a secondary transfer portion;

the periodic disturbance is a disturbance caused by decentration of the drive roller;

the other disturbance is a disturbance caused when the recording member rushes into the secondary transfer portion; and the phase angle of the periodic disturbance corresponds to a phase angle of the decentration of the drive roller.

* * * * *